US006176614B1

(12) United States Patent
Taylor

(10) Patent No.: US 6,176,614 B1
(45) Date of Patent: Jan. 23, 2001

(54) CELEBRITY AUTOGRAPH COLLECTOR DISK SYSTEM

(76) Inventor: Frank N. Taylor, 105 Suffolk Cir., Stephens City, VA (US) 22655

( * ) Notice: Under 35 U.S.C. 154(b), the term of this patent shall be extended for 0 days.

(21) Appl. No.: 09/296,503

(22) Filed: Oct. 12, 1999

(51) Int. Cl.[7] ..... B65D 33/16; A45C 1/00

(52) U.S. Cl. ..... 383/63; 383/106; 206/0.81; 206/0.82; 206/232

(58) Field of Search ..... 206/0.81, 232, 206/308.1, 0.82; 383/63, 106

(56) References Cited

U.S. PATENT DOCUMENTS

| | | | | |
|---|---|---|---|---|
| 2,597,227 | * | 5/1952 | Colliton | 206/0.82 X |
| 3,034,640 | * | 5/1962 | Evans | 206/0.82 |
| 4,385,688 | * | 5/1983 | Grant | 206/0.82 X |
| 4,807,806 | * | 2/1989 | Neiman | 206/232 X |
| 4,869,364 | * | 9/1989 | Bray | 206/232 |
| 4,878,580 | * | 11/1989 | Johnston | 206/232 X |
| 5,011,005 | * | 4/1991 | Boyd et al. | 206/0.81 |
| 5,168,988 | * | 12/1992 | Johnston | 206/0.81 |
| 5,415,290 | * | 5/1995 | Merkley et al. | 383/65 X |

FOREIGN PATENT DOCUMENTS

| | | | | |
|---|---|---|---|---|
| 1140723 | * | 8/1957 | (FR) | 383/63 |

* cited by examiner

*Primary Examiner*—Jes F. Pascua

(57) ABSTRACT

A celebrity autograph collector disk system for maintaining valuable objects in a safe environment is disclosed. The system includes at least one disk selected from a set of disks from a celebrity genre. Each disk is circular in shape and has a front face having an interior circle. The interior circle has primary indicia in the form of a picture of the face of a celebrity therein. Secondary indicia is provided in the space between the interior circle and the exterior circle. The secondary indicia includes the name of the pictured celebrity and the year of publication. The disk also has a reverse face with a pair of parallel lines extending thereacross to define a space for an autograph of the celebrity. The space above the parallel lines and below the parallel lines contain indicia correlated to the indicia on the front side including at least some alpha-numeric characters. Further provided is a bag in a generally rectangular configuration with a front sheet and a rear sheet to provide a supplemental vertical space constituting an opening. A separable seal is included along the length thereof with a projection on one sheet and a recess on the other sheet in a manner of a zip-lock baggie. The remainder of the portion of the bag has its front sheet and rear sheet sealed around the periphery remote from the opening. The bag is formed of a flexible transparent plastic material for the display of a disk therein.

7 Claims, 1 Drawing Sheet

FIG. 1
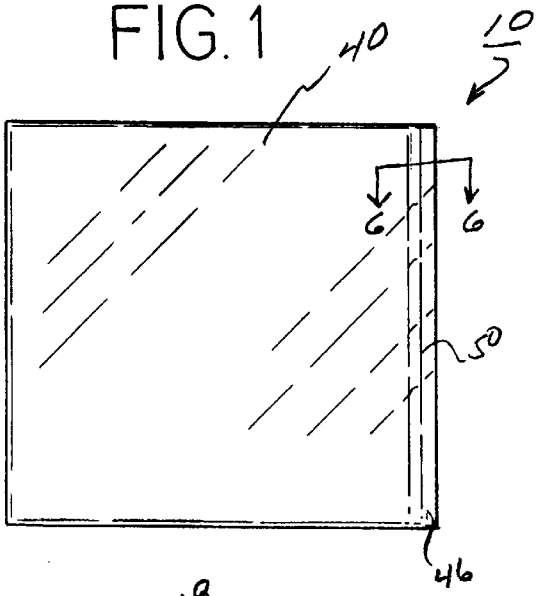
FIG. 2
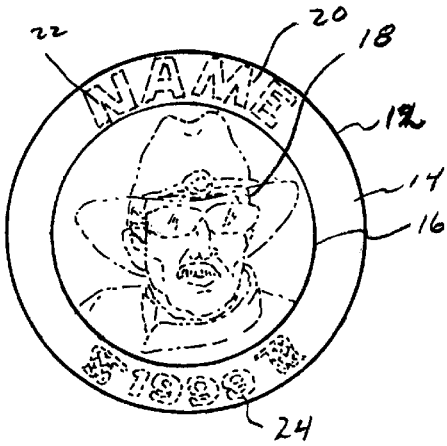
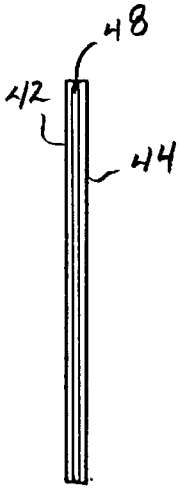
FIG. 3
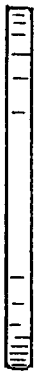
FIG. 4
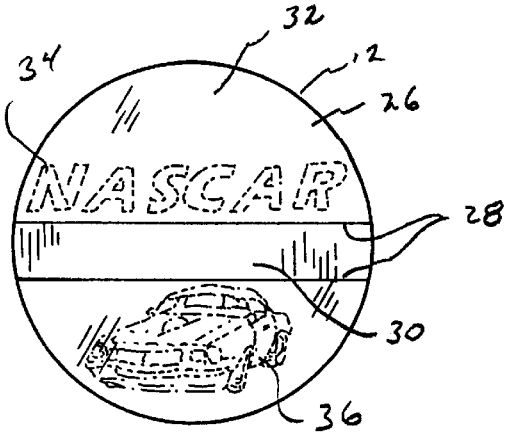
FIG. 5
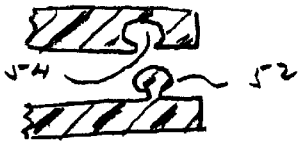
FIG. 6

CELEBRITY AUTOGRAPH COLLECTOR DISK SYSTEM

BACKGROUND OF THE INVENTION

1. Field of the Invention

The present invention relates to a new and improved celebrity autograph collector disk system and, more particularly, pertains to maintaining valuable objects such as autograph collector disks in a safe environment.

2. Description of the Prior Art

The use of collectibles and collection systems of known designs and configurations is known in the prior art. More specifically, collectibles and collection systems of known designs and configurations heretofore devised and utilized for the purpose of protecting objects including collectibles through known methods and apparatuses are known to consist basically of familiar, expected, and obvious structural configurations, notwithstanding the myriad of designs encompassed by the crowded prior art which has been developed for the fulfillment of countless objectives and requirements.

The prior art discloses a large number of collectibles and collection systems of known designs and configurations. By way of example, U.S. Pat. No. Des. 346,185 to Francis, issued Apr. 19, 1994 discloses a football card container. U.S. Pat. No. 3,417,497 to Hannon, issued Dec. 24, 1968, discloses an identification card. U.S. Pat. No. 3,758,970 to Annenberg, issued Sep. 18, 1973, discloses a photograph bearing identification card structure and method of manufacture. U.S. Pat. No. 5,328,207 to Hannah, issued Jul. 12, 1994, discloses an autographed photograph and method. U.S. Pat. No. 5,356,136 to Ippolito, issued Oct. 18, 1994, discloses an autograph combination, removably-attached ball and pen. Lastly, Foreign patent number EP 0 362 056 to Juteau, issued Sep. 9, 1989, discloses a portable registration book.

In this respect, the celebrity autograph collector disk system according to the present invention substantially departs from the conventional concepts and designs of the prior art, and in doing so provides an apparatus primarily developed for the purpose of maintaining valuable objects such as autograph collector disks in a safe environment.

Therefore, it can be appreciated that there exists a continuing need for a new and improved celebrity autograph collector disk system which can be used for maintaining valuable objects such as autograph collector disks in a safe environment. In this regard, the present invention substantially fulfills this need.

SUMMARY OF THE INVENTION

In view of the foregoing disadvantages inherent in the known types of collectibles and collection systems of known designs and configurations now present in the prior art, the present invention provides a new and improved celebrity autograph collector disk system. As such, the general purpose of the present invention, which will be described subsequently in greater detail, is to provide a new and improved celebrity autograph collector disk system and methods which have all the advantages of the prior art and none of the disadvantages.

To attain this, the present invention essentially comprises a new and improved celebrity autograph collector disk system for maintaining valuable objects in a safe environment. The system comprises, in combination, at least one disk selected from a set of disks from a celebrity genre. Each disk is circular in shape with an outside diameter of about three inches. Each disk has a front face having an interior circle with a diameter of between about 2 and 2½ inches, the interior circle having a primary indicia in the form of a picture of the face of a celebrity therein. Secondary indicia is provided in the space between the interior circle and the exterior circle, the secondary indicia including the name of the pictured celebrity and the year of publication. The reverse face of the disk has a pair of parallel lines extending thereacross to define a space for an autograph of the celebrity, the lines having a space therebetween of between ¼ inch and ½ inch. The space above the parallel lines and below the parallel lines have indicia correlated to the indicia on the front side including at least some alpha-numeric characters. The thickness of the disk measures between ⅛ inch and ¼ inch.

The next component of the system is a bag in a generally rectangular configuration, the bag having a front sheet and a rear sheet with a height of about 3½ inches and a width slightly greater than 3½ inches, preferably between 3⅝ and 3¾ inches. In this manner, a supplemental vertical space constitutes an opening including a separable seal along the length thereof with a projection on one sheet and a recess on the other sheet in a manner of a zip-lock baggie. The remainder of the portion of the bag has its front sheet and rear sheet sealed around the periphery remote from the opening. The bag is formed of a flexible transparent plastic material for the display of a disk therein.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved celebrity autograph collector disk system which has all the advantages of the prior art collectibles and collection systems of known designs and configurations and none of the disadvantages.

It is another object of the present invention to provide a new and improved celebrity autograph collector disk system which may be easily and efficiently manufactured and marketed.

It is a further object of the present invention to provide a new and improved celebrity autograph collector disk system which is of a durable and reliable construction.

An even further object of the present invention is to provide a new and improved celebrity autograph collector disk system which is susceptible of a low cost of manufacture with regard to both materials and labor, and which accordingly is then susceptible of low prices of sale to the consuming public, thereby making such a celebrity autograph collector disk system economically available to the buying public.

Even still another object of the present invention is to maintain valuable objects such as autograph collector disks in a safe environment.

Lastly, it is an object of the present invention to provide a celebrity autograph collector disk system for maintaining valuable objects in a safe environment. The system includes at least one disk selected from a set of disks from a celebrity genre. Each disk is circular in shape and has a front face having an interior circle. The interior circle has primary indicia in the form of a picture of the face of a celebrity therein. Secondary indicia is provided in the space between the interior circle and the exterior circle. The secondary indicia includes the name of the pictured celebrity and the year of publication. The disk also has a reverse face with a pair of parallel lines extending thereacross to define a space for an autograph of the celebrity. The space above the parallel lines and below the parallel lines contain indicia correlated to the indicia on the front side including at least some alpha-numeric characters. Further provided is a bag in a generally rectangular configuration with a front sheet and a rear sheet to provide a supplemental vertical space constituting an opening. A separable seal is included along the length thereof with a projection on one sheet and a recess on the other sheet in a manner of a zip-lock baggie. The remainder of the portion of the bag has its front sheet and rear sheet sealed around the periphery remote from the opening. The bag is formed of a flexible transparent plastic material for the display of a disk therein.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a front elevational view of the celebrity autograph collector disk system constructed in accordance with the principles of the present invention.

FIG. 2 is a front elevational view of the front face of the disk positionable in the bag of the system of FIG. 1.

FIG. 3 is an end elevational view of the bag shown in FIG. 1.

FIG. 4 is a side elevational view of the disk shown in FIG. 2.

FIG. 5 is a rear elevational view of the disk shown in FIG. 2.

FIG. 6 is a cross-sectional view taken along line 6—6 of FIG. 5.

The same reference numerals refer to the same parts throughout the various Figures.

DESCRIPTION OF THE PREFERRED EMBODIMENT

With reference now to the drawings, and in particular to FIGS. 1 through 6 thereof, the preferred embodiment of the new and improved celebrity autograph collector disk system embodying the principles and concepts of the present invention and generally designated by the reference numeral 10 will be described.

The present invention, the new and improved celebrity autograph collector disk system, is a system 10 comprised of a plurality of components. Such components, in their broadest context, include at least one disk, and a resealable bag. Each of the individual components is specifically configured and correlated one with respect to the other so as to attain the desired objectives.

The present invention is a new and improved celebrity autograph collector disk system 10 for maintaining valuable objects in a safe environment.

The present invention includes at least one disk 12 selected from a set of disks from a celebrity genre. Each disk is circular in shape with an outside diameter of about three inches. The disk further includes a front face 14 having an interior circle 16 with a diameter of between about 2 and 2½ inches. The interior circle has a primary indicia in the form of a picture 18 of the face of a celebrity therein. Secondary indicia 20 is provided in the space between the interior circle and the exterior circle. The secondary indicia includes the name 22 of the pictured celebrity and the year 24 of publication. The disk also has a reverse face 26. The reverse face of the disk has a pair of parallel lines 28 extending thereacross to define a space 30 for an autograph of the celebrity. The parallel lines have a space therebetween of between ¼ inch and ½ inch. The space 32 above the parallel lines and below the parallel lines have indicia 34,36 correlated to the indicia on the front side including at least some alpha-numeric characters. The thickness of the disk is between ⅛ inch and ¼ inch.

Further provided as a component of the system 10 is a protective bag 40. The bag has a generally rectangular configuration. The bag has a front sheet 42 and a rear sheet 44 with a height of about 3½ inches and a width slightly greater than 3½ inches, preferably between 3⅝ and 3¾ inches. In this manner, a supplemental vertical space 46 is provided which constitutes an opening 48 including a separable seal 50 along the length thereof. A projection 52 is located on one sheet and a recess 54 is located on the other sheet in a manner of a zip-lock baggie. The remainder of the portion of the bag has its front sheet and rear sheet sealed around the periphery remote from the opening. The bag is formed of a flexible transparent plastic material for the display of a disk therein.

The present invention is a concept for development of a new type of celebrity or sport collectible item. The disk of the system will be formed of plastic or lightweight metal and will measure approximately 3 inches in diameter. Each disk will feature a picture of the celebrity/group/team/or the like centered on one side. The other side of the disk will feature other relevant information such as pictures or data concerning the celebrity as well as a blank strip upon which the celebrity's autograph may be collected.

The disk of the present invention will be packaged in a clear plastic case or bag and can be produced in series relating to a wide range of celebrity genres. Such genre may include music industry celebrities or groups; sports industry such as baseball, basketball, football, hockey, soccer, car racing; and entertainment industry such as actors, TV shows, movies.

The celebrity autographed collector disks may be offered through the same channels as traditional sports trading cards, or they may be employed by retailers as promotional or incentive items. They may also be used by the celebrities themselves as promotional giveaway or fund-raising items.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A celebrity autograph collector disk system for maintaining valuable objects in a safe environment comprising:

at least one disk selected from a set of disks from a celebrity genre, each disk being circular in shape and with a front face having an interior circle, the interior circle having a primary indicia in the form of a picture of the face of a celebrity therein with secondary indicia in the space between the interior circle and the exterior circle, the secondary indicia including the name of the pictured celebrity and the year of publication, the disk having a reverse face with a pair of parallel lines extending thereacross to define a space for an autograph of the celebrity, the space above the parallel lines and below the parallel lines having indicia correlated to the indicia on the front side including at least some alpha-numeric characters; and a bag in a generally rectangular configuration, the bag having a front sheet and a rear sheet to provide a supplemental vertical space constituting an opening including a separable seal along the length thereof with a projection on one sheet and a recess on the other sheet, the remainder of the portion of the bag having its front sheet and rear sheet sealed around the periphery remote from the opening, the bag being formed of a flexible transparent plastic material for the display of a disk therein.

2. The celebrity autograph collector disk system for maintaining valuable objects in a safe environment as set forth in claim 1 wherein the disk has an outside diameter of about three inches.

3. The celebrity autograph collector disk system for maintaining valuable objects in a safe environment as set forth in claim 1 wherein the interior circle of the front face of the disk has a diameter of between about 2 and 2½ inches.

4. The celebrity autograph collector disk system for maintaining valuable objects in a safe environment as set forth in claim 1 wherein the pair of parallel lines on the front face of the disk has a space therebetween of between ¼ inch and ½ inch.

5. The celebrity autograph collector disk system for maintaining valuable objects in a safe environment as set forth in claim 1 wherein the disk has a thickness of between ⅛ inch and ¼ inch.

6. The celebrity autograph collector disk system for maintaining valuable objects in a safe environment as set forth in claim 1 wherein the bag of the system has a front sheet and a rear sheet with a height of about 3½ inches and a width slightly greater than 3½ inches, preferably between 3⅝ and 3¾ inches.

7. A celebrity autograph collector disk system for maintaining valuable objects in a safe environment comprising, in combination:

at least one disk selected from a set of disks from a celebrity genre, each disk being circular in shape with an outside diameter of about three inches and with a front face having an interior circle with a diameter of between about 2 and 2½ inches, the interior circle having a primary indicia in the form of a picture of the face of a celebrity therein with secondary indicia in the space between the interior circle and the exterior circle, the secondary indicia including the name of the pictured celebrity and the year of publication, the disk having a reverse face with a pair of parallel lines extending thereacross to define a space for an autograph of the celebrity, the lines having a space therebetween of between ¼ inch and ½ inch, the space above the parallel lines and below the parallel lines having indicia correlated to the indicia on the front side including at least some alpha-numeric characters, the disk having a thickness of between ⅛ inch and ¼ inch; and a bag in a generally rectangular configuration, the bag having a front sheet and a rear sheet with a height of about 3½ inches and a width slightly greater than 3½ inches, preferably between 3⅝ and 3¾ inches to provide a supplemental vertical space constituting an opening including a separable seal along the length thereof with a projection on one sheet and a recess on the other sheet, the remainder of the portion of the bag having its front sheet and rear sheet sealed around the periphery remote from the opening, the bag being formed of a flexible transparent plastic material for the display of a disk therein.

* * * * *